United States Patent [19]

Akman

[11] Patent Number: 4,997,403

[45] Date of Patent: Mar. 5, 1991

[54] BALLOON LIGHTING DEVICE

[76] Inventor: Alp T. Akman, 1195-A Linda Vista Dr., San Marcos, Calif. 92069

[21] Appl. No.: 457,108

[22] Filed: Dec. 26, 1989

[51] Int. Cl.[5] ..... A63H 3/06; A63H 33/26; F21V 33/00; G09F 21/06

[52] U.S. Cl. ..... 446/220; 446/223; 446/485; 362/96; 383/96; 40/214

[58] Field of Search ..... 446/220, 221, 222, 223, 446/224, 225, 226, 485; 362/806, 808, 809, 96, 101, 278, 363; 383/96; 40/214, 212, 610, 555

[56] References Cited

U.S. PATENT DOCUMENTS

| | | | |
|---|---|---|---|
| 1,530,923 | 3/1925 | Anns | 446/224 |
| 1,776,182 | 9/1930 | Cook | 362/278 X |
| 1,912,960 | 6/1933 | Aki et al. | 446/224 |
| 2,924,041 | 2/1960 | Jackson et al. | 446/224 |
| 3,536,906 | 10/1970 | Bloom | 446/485 X |
| 3,592,157 | 7/1971 | Schwartz | 446/220 X |
| 3,745,677 | 7/1973 | Moran | 446/220 X |
| 3,905,368 | 9/1975 | Lewis, Jr. et al. | 383/96 X |
| 4,142,322 | 3/1979 | Zeyra | 446/224 |
| 4,542,445 | 9/1985 | Marletta | 446/485 X |
| 4,586,910 | 5/1986 | Buchanan | 446/220 |

FOREIGN PATENT DOCUMENTS

| | | | |
|---|---|---|---|
| 525715 | 5/1931 | Fed. Rep. of Germany | 446/220 |
| 3015962 | 4/1980 | Fed. Rep. of Germany | 446/485 |
| 599136 | 1/1926 | France | 446/485 |
| 785377 | 5/1935 | France | 40/214 |
| 8605255 | 9/1986 | PCT Int'l Appl. | 446/485 |
| 2042136 | 9/1980 | United Kingdom | 446/485 |

*Primary Examiner*—Robert A. Hafer
*Assistant Examiner*—D. Neal Muir
*Attorney, Agent, or Firm*—Calif Kip Tervo

[57] ABSTRACT

A novelty balloon lighting device involving an inflated balloon having a plug fitted inside the neck of the balloon the plug having a bore formed therethrough and containing therein at least one concentric constriction ring, an elongated hollow tube having spaced-apart terminal ends of an outside diameter such that the tube forms a sliding air-tight seal with the constriction ring when inserted in the bore, a light bulb sealed in one end of the tube for insertion into the interior of the inflated balloon and a pair of electric conductors extending from the bulb passing along the interior of the tube external the balloon and an electrical energy source for attaching the electrical conductors thereto for lighting the light bulb inside the balloon.

2 Claims, 3 Drawing Sheets

BALLOON LIGHTING DEVICE

BACKGROUND OF THE INVENTION

1. Field of the Invention

This invention pertains to the field of novelty and decorative devices. More particularly, it pertains to interiorly balloons for use at parties and in decorations where the balloons may be self-supporting or supported on thin, flexible, elongated tubes.

2. Description of the Prior Art

Balloons have long entranced people as a beautiful decoration and a lively entertainment device. Many balloons of different colors may be tied together in various arrangements for decoration purposes. Different size and shaped balloons are often hung about a party room to brighten the atmosphere. When, however, the exterior lighting becomes dim, such as in the evening on a patio or when the lights are turned low, the loss of illumination reduces the attractiveness of balloons. The prior art has attempted to solve this problem by positioning light bulbs interior of the balloons so that they possess their own light. Unfortunately, such devices are expensive, are difficult to use and in many cases, fail to achieve the desired purpose.

Most of the prior art devices center around light bulb sockets wherein a light bulb is inserted and over which the neck of the balloon is stretched to place the light bulb interior thereof. For the most part, these have been unsuccessful because either the seal between the neck and the socket is not sufficiently air tight, thereby allowing the balloon to slowly deflate, or, the heat produced by the light bulb is sufficiently intense to damage the balloon film causing it to burst. In addition, the means by which the sockets have been inserted into the neck of the balloon have been of the type requiring pneumatic sealing materials to be placed thereabout, thereby making the overall device very cumbersome and costly.

This invention is a novel balloon lighting device that achieves the desired purposes of being an easily assembled device that is low-cost and highly efficient in maintaining the required pneumatic seal about the neck of the balloon and at the same time provides the additional feature of allowing the light bulb to be moved freely about the interior of the inflated balloon so as to permit achievement of more decorative and highly fashionable arrangements.

These results are achieved by providing a unique plug or gate-valve for insertion in the neck of the balloon that has a bore formed therethrough containing at least one concentric constriction ring interior thereof for receipt of a hollow tube that will form a slidable yet air-tight seal within the plug. A light bulb, preferably one having an outside diameter less than the diameter of the tube, is pneumatically sealed to one end of the tube and its electric conductors are threaded down through the interior of the tube to extend out the other end. The tube is thereafter slipped inside the bore of the plug and the conductors connected to an energy source to cause the light bulb to light the interior of the inflated balloon. The tube may be slid further into the balloon or withdrawn partially therefrom so as to allow repositioning of the light within the interior of the balloon.

The special plug or gate-valve is made of low-cost plastic and is easily inserted inside the neck of the balloon, either before or after the balloon is inflated. It is insertable in the neck of a deflated balloon to aid the user in inflating the balloon. In one preferred embodiment, a short, hollow stub helps form the bore in the plug to which a pneumatic source, such as helium or compressed air, may be attached with ease to inflate the balloon.

A simple energy source is provided to which the conductor wires are attached and will provide the requisite power at the appropriate voltage and current. Short pieces of hollow tubing containing a pneumatically sealed light bulb may be used in lieu of the elongated tubing thereby allowing the helium-filled balloons to freely bob and weave about tethered to the energy source only by their thin wire conductors so as to provide for even more opportunity to make unique lighted balloon arrangements.

SUMMARY OF THE INVENTION

It is a main object of this invention to provide a low-cost and easily assembled combination of elements to obtain a novel balloon lighting device for use in a wide variety of settings. A further object of the invention is to provide a balloon lighting device capable of having the light bulb repositionable about the interior of the expanded balloon without achieving a loss in balloon air pressure. Further objects include a unique plug for insertion into a balloon that thereafter permits inflation of the balloon without the attendant leakage problems of the prior art. A still further object is to provide a unique plug or gate-valve usable in a wide variety of balloons to permit rapid employment of a light source within the interior of the balloon.

These and other objects of the invention will become more apparent upon reading the following description of the preferred embodiment taken together with the drawings appended hereto. The scope of protection sought by the inventor may be gleaned from a fair reading of the claims that conclude this specification.

DESCRIPTION OF THE PREFERRED EMBODIMENT

Figure 2:
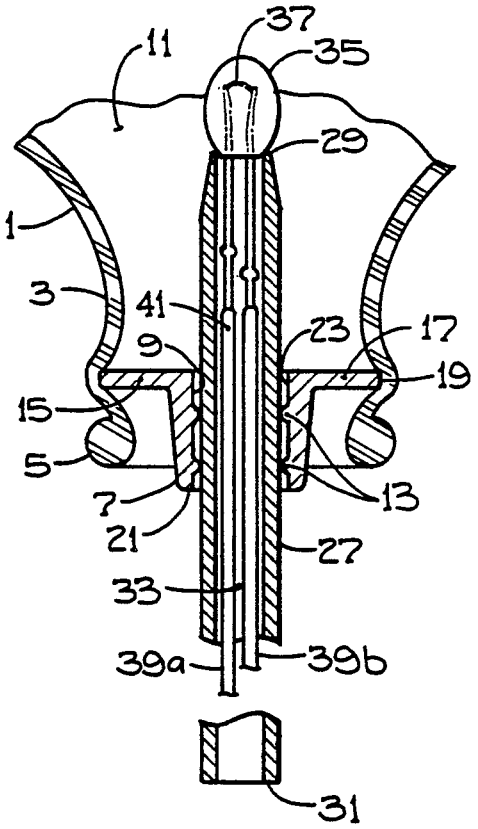
FIG. 2 is a partial cross-sectional view of the plug used in this invention taken along lines 2—2 in FIG. 1.

This invention is useful with balloons of all sizes and shapes, the only requirement being that they have a short hollow neck extending therefrom through which air or other expanding gas may pass. As shown in FIG. 2, this invention involves an inflatable balloon 1 having a hollow, flexible stub-like neck 3 extending therefrom terminating in a circular thickened end lip 5 through which is normally passed the expanding gasses, either compressed air or compressed helium, to inflate balloon 1. Unique plug or gate-valve 7 is provided adapted for a pneumatically tight fit inside neck 3 and has a bore 9 formed therethrough for access to the interior 11 of said balloon.

Figure 1:
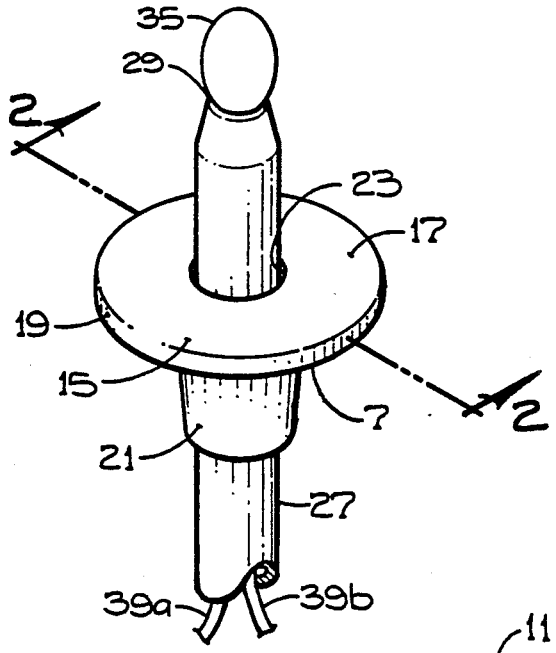
FIG. 1 is a perspective, partially fragmentary view of one of the preferred embodiments of this invention.

At least one and preferably two concentric constriction rings 13 are formed interior of bore 9 for purposes to be hereinafter more fully described. Plug 7 includes a planar member 15 such as a round or circular thin disk 17 as shown in FIGS. 1, 2 and 4 for positioning crosswise or transverse in neck 3. It is important that the outer edge 19 or circumference of planar member 15 be of a size larger than neck so that during transverse positioning therein, neck 3 will stretch over edge 19 so that, in combination with the constriction of end lip 5 will form a pneumatic seal therebetween.

Where planar member 15 is thin, such as in the form of disk 17, bore 9 is preferably formed using a short, hollow stub 21 extending outward from an aperture 23 formed through planar member 15 and either attached thereto or formed as a unitary piece as shown in FIGS. 2 and 4. In this configuration, constriction ring or rings 13 are more conveniently placed inside that portion of bore 9 formed inside stub 21 as shown in FIG. 2. Further, it is preferable that stub 21 extend outward from aperture 23 perpendicular or normal to planar member 15.

Figure 3:
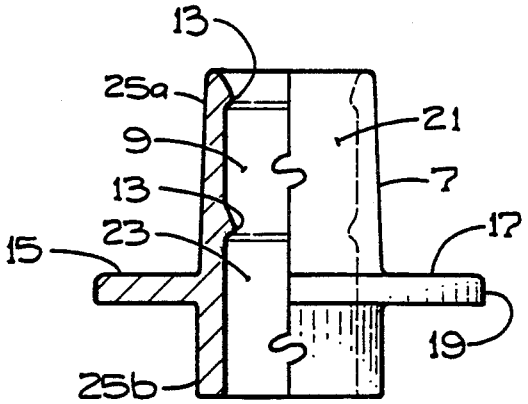
FIG. 3 is a sectional side view of another embodiment of the plug or gate-valve used in this invention; and, FIGS. 4*a*–4*d* are perspective views of various configurations of balloons using the plugs, tubes and energy sources of this invention.

Even further preferred is where plug 7 is formed by a pair of short, hollow stubs, 25*a* and 25*b*, held or placed in mutual alignment as shown in FIG. 3, and extending from opposite sides of aperture 23 formed in disk 17 and normal or perpendicular to the plane thereof. It is preferred that aperture 23 be located central in disk 1. In this latter configuration, concentric rings 13 may be formed inside of either stub 25*a*, 25*b* or one or more formed in each one without departing from the scope and spirit of this invention.

A hollow tube 27 having spaced-apart terminal ends 29 and 31 and having a hollow interior 33 formed therein, is provided having an outside diameter of such a size as to form a sliding air-tight seal with constriction rings 13 when tube 27 is inserted in plug bore 9. Plug 7 and tube 27 are preferably made of low-cost thermoplastic polymeric material such as polystyrene, polyethylene, polyvinylchloride or combinations thereof as is already known in the art. These materials are specifically adaptable to being injection molded or extruded so that such members may be made in large quantity using high-speed and high-volume forming techniques to reduce their cost.

A light bulb or incandescent lamp 35, preferably of the miniature type such as is found in computers and other devices involving miniature electronics, is mounted in tube terminal end 29 in such a manner as to form a pneumatic seal with tube interior 33 such as with the use of sealant-adhesives such as epoxy, acrylic, or silicone-type adhesives as is already known in the art. These type bulbs or lamps are known in the art as "subminiature" lamps and are obtainable from such sources as WAMCO, INC., 11555 Coley River Cir., Fountain Valley, Calif. 92708. They have a bulb diameter equal to or less than the diameter of tube 27. Lamp 35 generally has positioned therein a fine filament 37 providing light when energized with the proper amount of electric voltage, said filament 37 connected to a pair of fine electric conductor wires 39*a* and 39*b* that extend out from bulb 35 and down into tube hollow interior 33 for passage outside or external balloon 1. Conductors 39 are generally fine copper or copper alloy wires having a coating of insulation 41 thereover and may be as fine as threads.

Usable with this invention is an electrical energy source 43 that may be of a wide variety of types the prerequisite being that it provide the proper voltage of electricity, either in direct current or alternating current, to energize filament 37 and produce light from light bulb 35.

Figure 4A:
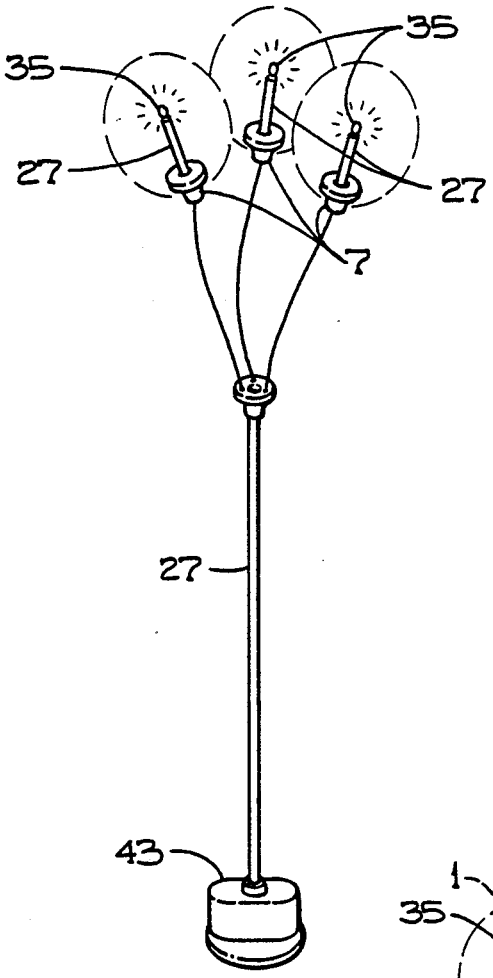
Figure 4B:
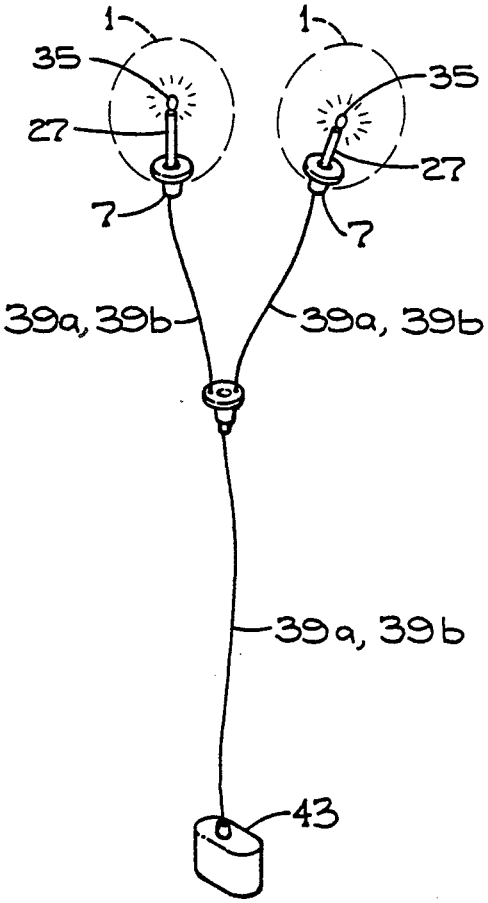
Figure 4C:
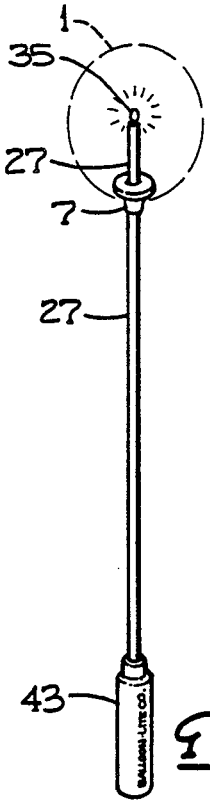

Another form of the invention is shown in FIG. 4*c* where hollow tube 27 is sufficiently rigid enough to support the lighted balloon 1 in spaced-apart relationship above energy source 43. In this configuration, hollow tube 27 is preferred to be of the type having a thin-enough wall to allow it to support the weight of the lighted balloon above energy source 43 but at the same time being sufficiently flexible to allow wind or air from a fan or otherwise oscillate lighted balloon 1 above energy source 43 to provide a colorful and unique decorative arrangement.

In another embodiment, shown in FIG. 4*b* of this invention, a plurality of balloons 1 are filled with helium gas, each contains a plug 7 in the respective necks 3 and a short length of hollow tube 27 supports light bulb 35 in each balloon. The separate pairs of conductors 39*a* and 39*b* are attached to a single plug 7 that acts as an anchor point for the balloons while they float above.

In still another embodiment, shown in FIG. 4*a*, a plurality of balloons 1 is attached to common plug 7 and an elongated pair of conductors 39*a* and 39*b* are used to interconnect common plug 7 to energy source 43 through a single tube 27. In this embodiment, the helium-filled balloons float above energy source 43 tethered thereto by fine wire conductors 39*a* and 39*b*.

Figure 4D:
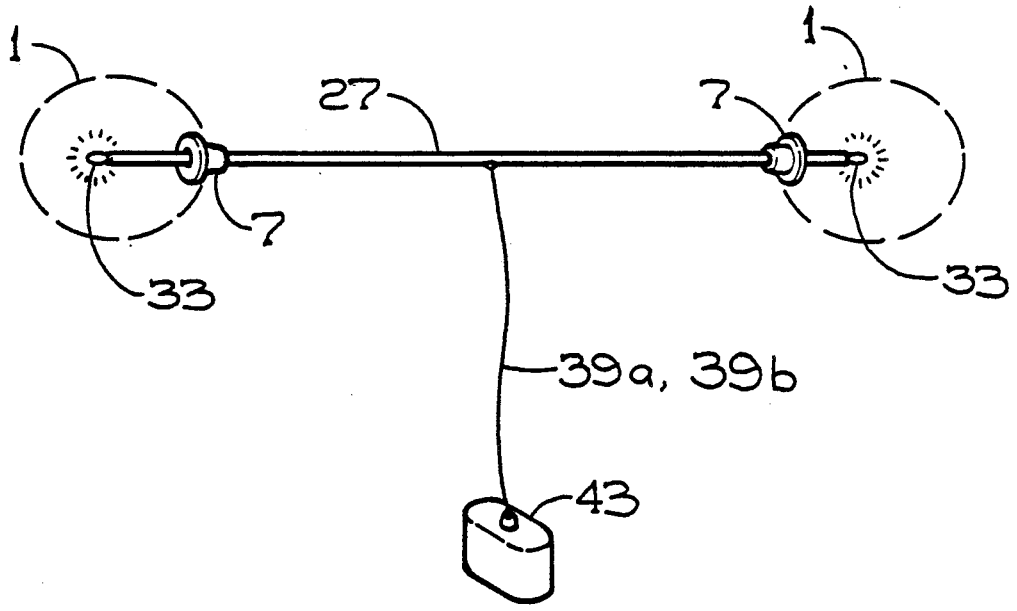

A still further embodiment, shown in FIG. 4*d*, is a pair of balloons 1 attached together through use of a single tube 27 so that they are held in spaced-apart fixed geometry. They may be supported above energy source 43 by filling them with helium or be suspended from above by wires or strings; in all cases they are electrically connected to energy source by conductors 39*a* and 39*b*. More than two balloons 1 may be interconnected by fixing tube 27 in a cross-shape or star-shape, etc. and join them at their respective intersections with cutting and gluing as is presently known in the art. In these cases, conductors 39*a* and 39*b* will be interatached to provide electric energy to each of bulbs 33.

What is claimed is:

1. A novelty balloon lighting device comprising, in combination:

(a) an inflatable balloon having a neck portion;

(b) a plug adapted for a pneumatically tight-fit inside said neck and having a bore formed therethrough for access to the interior of said balloon, said bore including at least one concentric constriction ring interior thereof;

(c) a hollow tube having an interior and having spaced-apart terminal ends of an outside diameter forming a sliding air-tight seal with said ring when inserted through said bore;

(d) a light bulb attached to one terminal end of said hollow tube in pneumatic sealing relationship therewith for positioning inside said balloon and including a pair of electric conductors passing from said balloon along said interior of said tube external said balloon; and (e) an electric energy source for connection to said conductors to generate light in said bulb inside said balloon; and;

wherein a plurality of balloons are each fitted with said plug, a short length of said tube and said light bulb and are thereafter joined by their said conductors to said energy source.

2. A novelty balloon lighting device comprising, in combination:

(a) an inflatable balloon having a neck portion;

(b) a plug adapted for a pneumatically tight-fit inside said neck and having a bore formed therethrough for access to the interior of said balloon, said bore including at least one concentric constriction ring interior thereof;

(c) a hollow tube having an interior and having spaced-apart terminal ends of an outside diameter forming a sliding air-tight seal with said ring when inserted through said bore;

(d) a light bulb attached to one terminal end of said hollow tube in pneumatic sealing relationship therewith for positioning inside said balloon and including a pair of electric conductors passing from said balloon along said interior of said tube external said balloon; and (e) an electric energy source for connection to said conductors to generate light in said bulb inside said balloon; and wherein at least two balloons are each fitted with said plug and a single length of said tube, and said bulb is placed in each balloon and said tube is thereafter joined to said energy source by said conductors.

* * * * *